United States Patent [19]

Kaufmann

[11] Patent Number: 4,984,384

[45] Date of Patent: Jan. 15, 1991

[54] BIO-DEGRADABLE MULCHING MATERIAL

[75] Inventor: David A. Kaufmann, Gambrills, Md.

[73] Assignee: Kaufmann, Bryan Environmental Concepts, Inc., Gambrills, Md.

[21] Appl. No.: 441,347

[22] Filed: Feb. 21, 1989

Related U.S. Application Data

[63] Continuation of Ser. No. 30,025, Mar. 25, 1987, abandoned.

[51] Int. Cl.[5] ..... A01G 7/00; E02B 3/04; E02B 3/12

[52] U.S. Cl. ..... 47/9; 405/15; 405/16; 405/258; 47/32

[58] Field of Search ..... 405/15, 16, 19, 25, 405/29, 30–32, 20, 33–35; 47/9, 25, 32, 56; 428/179, 180, 44, 132

[56] References Cited

U.S. PATENT DOCUMENTS

| | | | |
|---|---|---|---|
| 1,870,110 | 8/1932 | Hall | 47/9 |
| 2,038,019 | 4/1936 | Wright | 47/9 |
| 3,287,851 | 11/1966 | Cramer | 47/25 |
| 3,315,408 | 4/1967 | Fisher | 405/19 X |
| 4,135,843 | 1/1979 | Umemoto et al. | 405/19 X |
| 4,472,086 | 9/1984 | Leach | 405/32 |
| 4,594,023 | 6/1986 | O'Neill | 405/29 |

FOREIGN PATENT DOCUMENTS

| | | | |
|---|---|---|---|
| 2552621 | 4/1985 | France | 47/9 |
| 176317 | 10/1983 | Japan | 405/16 |
| 1130643 | 12/1984 | U.S.S.R. | 405/29 |
| 709279 | 5/1954 | United Kingdom | 428/180 |
| 2207168 | 1/1989 | United Kingdom | 405/19 |

*Primary Examiner*—Danton D. DeMille

*Attorney, Agent, or Firm*—Nixon & Vanderhye

[57] ABSTRACT

A method provides and apparatus for recovering and revegetating shorelines subjected to low to moderate wave energy and other terrains subject to erosion processes. Biodegradable, cardboard sheet material formed with an array of projections and depressions over the entire surface of the material is utilized. A plurality of plant-receiving and letting apertures are formed in the sheet in accordance with predetermined plant density requirements. The sheet material is formed with plant nutrients suspended in it and is further provided with a hydrophobic composition coating for delaying biodegradation. The surface pattern formed on the sheet dissipates wave energy, traps sand and sediment, and prevents plant washout. The sheet material is secured to the surface by a plurality of biodegradable stakes.

28 Claims, 2 Drawing Sheets

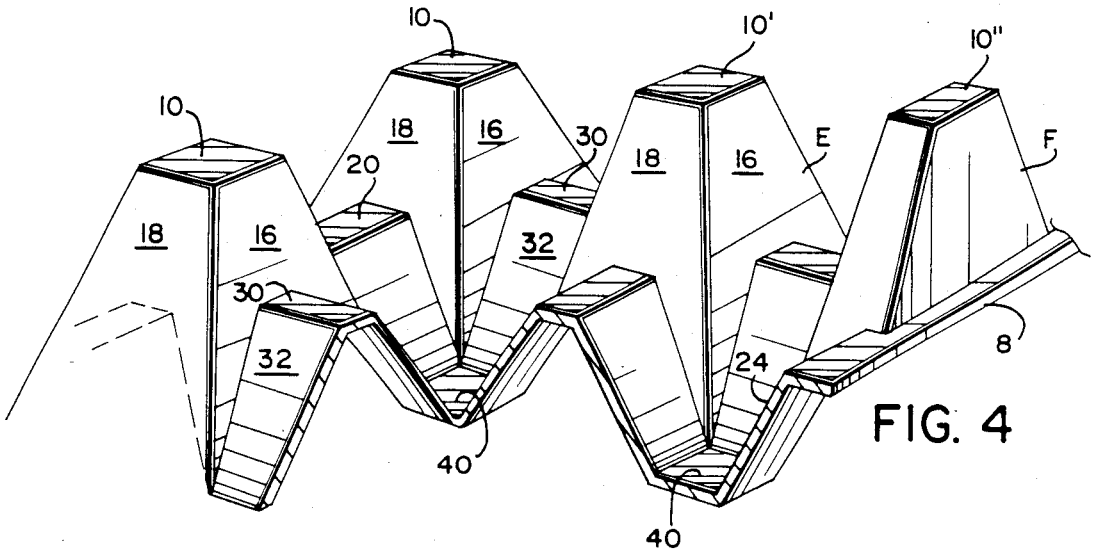
FIG. 4
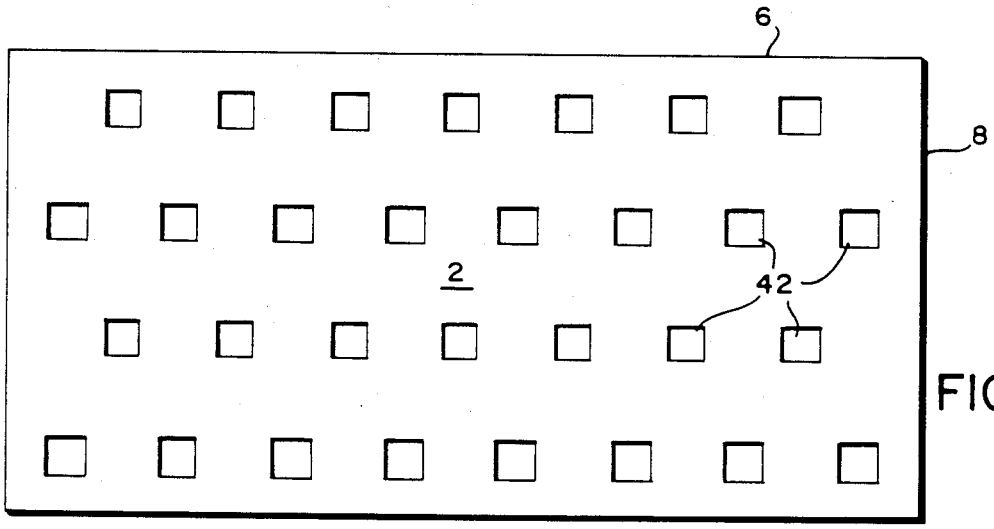
FIG. 5
FIG. 6
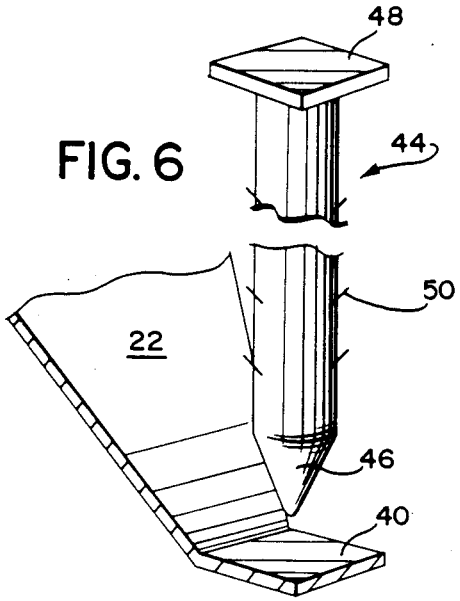

BIO-DEGRADABLE MULCHING MATERIAL

This is a continuation of application Ser. No. 07/030,025, filed Mar. 25, 1988, now abandoned.

BACKGROUND AND SUMMARY OF THE INVENTION

The present invention relates to a method and apparatus for recovering and revegetating soil, particularly along shorelines, where the erosive effects of wind and waves cause enormous ecological damage and economic loss. The invention is also suitable for use in a variety of other terrestrial applications, such as on slopes, in ditches, and in natural drainage areas subject to erosion processes.

Various attempts have been made to control erosion, and at the same time, to encourage plant growth. For example, in U.S. Pat. Nos. 4,353,946 and 4,283,445, so called "mulch blankets" are disclosed which are fairly complex structures containing fibrous materials, held together by biodegradable binders. These structures are typically expensive to manufacture, and difficult to handle by reason of their great weight.

Attempts have also been made to fix sandy soil or other substrates by spraying vinyl emulsions, petroleum mulches, etc. to form a crust on the soil. The crusts, however, are often destroyed by wind and/or other physical disturbance.

In U.S. Pat. No. 4,158,932, a non-woven textile filament network is positioned over sandy terrain, and is said to prevent erosion while allowing seeds to germinate.

These approaches, however, are not completely satisfactory and are not particularly suited for use in coastal areas subjected to moderate wave energy.

Typically, erosion control in coastal zones involves massive planting of shrubs and/or grasses. While this approach is oftentimes successful in low energy areas, i.e., areas with little or no wave action, in moderate and high energy wave areas the shrubs and grasses are often washed away, particularly in the time period immediately after planting and before the root systems of the plants have had a chance to develop and anchor plants to the substrate.

In high energy wave areas, structural barriers such as wooden bulkheads and offshore breakwater are often employed with varying degrees of success.

There remains a real need for an effective system of erosion prevention and revegetation in low to moderate wave energy areas, and in other terrestrial applications where conventional planting techniques have not been successful, and where the more extreme structural approach is undesirable for aesthetic and/or economic reasons.

This invention provides a simple and inexpensive, yet extremely effective solution to the problem of erosion and plant growth areas subject to erosion and particularly in coastal zones exposed to moderate to low wave energy. According to this invention, a lightweight, flexible and biodegradable mulching material is employed which protects newly installed plants from washout; encourages sand aggregation from sediment suspended in the water; and stabilizes the shoreline or other substrate. These functions are accomplished by providing the mulching material in sheet form, with upper and lower, three dimensional surface configurations for dissipation of energy as waves (or drain water) flow over, through and around the surface contours of the material. These same contours also serve as traps for accumulating sand, and therefore preventing washout.

More specifically, the mulching material in accordance with this invention is constructed of lightweight material, preferably cardboard, rolled or stamped to include three-dimensional contours on its upper and lower surfaces in a manner similar to conventional egg cartons, and as described in more detail below.

The material is also preferably provided with suitable soil and plant nutrients which are released as the sheet degrades over time. In addition, the sheet material is also provided with a plurality of apertures to facilitate installation of plants such as salt marsh hay, smooth cordgrass or other suitable grasses, plants, etc. in the area to be recovered. It will be appreciated that the number and size of the apertures will depend on the plant density requirements, initial and mature size of the plants, and so on.

The biodegradable sheet is further provided with a hydrophobic surface coating, such as a paraffin composition, which will delay biodegradation of the material to insure plant root development.

The material may be manufactured in any number of standard or custom sizes. For example, four by eight foot sheets provide a convenient and easily workable size for large areas. Other sizes may be produced, depending on the terrain, the area to be covered, etc.

The biodegradable mulching material according to this invention is thus seen to have the following advantages:

(1) It is flexible enough to follow the natural contours of the shoreline or other terrain;

(2) It stabilizes existing shoreline or other terrain from further erosion;

(3) It can be used to accommodate a wide range of vegetation;

(4) It provides protected areas for rhizome development by allowing sunlight through small openings in the sheet surrounding the plants;

(5) It provides a predetermined density format for placement of plants;

(6) It can be produced in a variety of sizes and shapes;

(7) It can be dyed to the desired shade so as to be virtually invisible;

(8) It is inexpensive to produce and easy to install; and (9) It is extremely light, easy to work with, store, and transport.

Additional objects, advantages and details with respect to the invention are made apparent from the detailed description taken in conjunction with the accompanying drawings.

BRIEF DESCRIPTION OF THE DRAWINGS

FIG. 4 is a three-dimensional perspective view of a portion of the mulching sheet disclosed in FIG. 1;

FIG. 5 is a schematic view of a mulching sheet in accordance with this invention provided with a plurality of plant-receiving apertures; and FIG. 6 is a perspective view of a sheet securing stake in association with a portion of a mulching sheet in accordance with the invention.

DETAILED DESCRIPTION OF THE INVENTION

Figure 1:
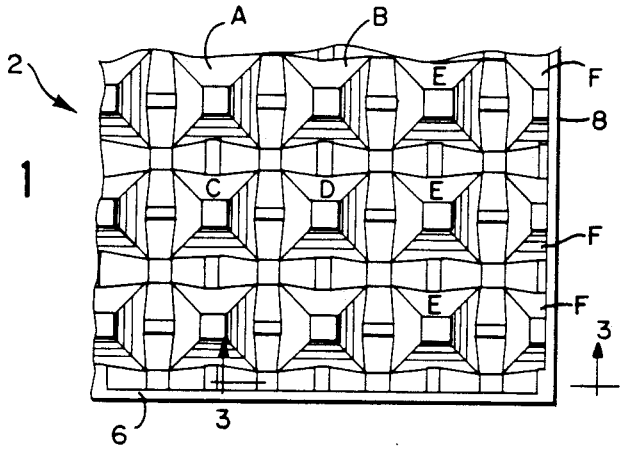
FIG. 1 is a plan view of a portion of a biodegradable mulching sheet in accordance with an exemplary embodiment of the invention, prior to the forming of plant-receiving apertures therein.

Referring generally to FIGS. 1 through 4, a portion of sheet 2 of mulching material in accordance with this invention is shown. Because of the repetitive pattern formed on the sheet, only so much of the sheet is illustrated as will insure a complete understanding of the invention. The sheet is defined by lengthwise edges 6 and widthwise edges 8 (only one each of which is shown) and would typically measure 4 by 8 feet. However, other sizes may be utilized as well, depending on a variety of factors including the nature of the terrain, the area to be covered, and so on.

The sheet material, as previously noted, is preferably constructed of lightweight cardboard and is manufactured much in the same manner as cardboard egg cartons. In addition, suitable plant nutrients or other fertilizers may be suspended in the material during manufacture for slow release as the material degrades over time.

The sheet is characterized by multiple geometric surface configurations creating a repetitive pattern of peaks and valleys, or undulations, somewhat similar in form to those found in cardboard egg cartons.

Again, because of the multiplicity of repeating surfaces forming the sheet, reference numerals have been applied, and detailed description will be given, with respect to only so many of the surfaces as required to achieve a full understanding of the overall sheet configuration.

Figure 2:
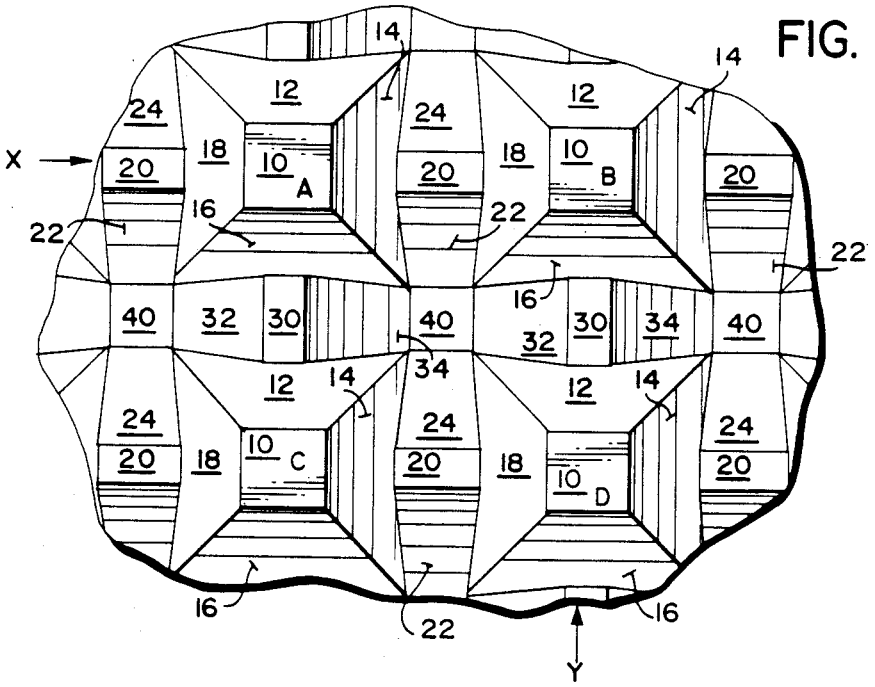
FIG. 2 is a detailed plan view of a portion of the sheet illustrated in FIG. 1.

One may describe the mulching sheet of this invention as being made up of a regular grid comprising a plurality of rows of truncated pyramids. Four of the pyramids are shown at A, B, C and D in FIGS. 1 and 2 wherein pyramids A and B are in one horizontal row, and pyramids C and D are in an adjacent horizontal row. The pattern illustrated in FIGS. 1 and 2 is a repetitive square-grid pattern wherein the pyramids are arranged in rows which are parallel in perpendicular directions. Thus, it will be appreciated that, as viewed in FIGS. 1 and 2, pyramids A and C are also in one vertical row, while pyramids B and D are in an adjacent vertical row. It is to be understood, of course, that references to "vertical" and "horizontal" are used merely for ease of understanding with reference to the drawings.

Each pyramid A. B, C and D defines, in an exemplary embodiment of the invention, about a 1.50 to 2.00 inch square, and includes four upwardly extending, and inwardly tapering side surfaces 12, 14, 16 and 18. Each is truncated to form a flat top surface or peak 10, although the pyramids may be pointed if desired.

Each side surface 12, 14, 16 and 18 of a pyramid is connected to a corresponding side surface of an adjacent pyramid by flat surfaces 20 or 30. It will be noted that surfaces 20 are, in the plan view of FIG. 2, elongated in the direction of horizontally extending rows of pyramids denoted by arrow X, while surfaces 30 are elongated in the direction of vertically extending rows of pyramids denoted by arrow Y.

Trapezoid-like surfaces 22, 24 extend downwardly from each surface 20 while similar surfaces 32, 34 extend downwardly from each surface 30. It will be seen that surfaces 22, 24, and 32 and 34 extending downwardly from surfaces 20 and 30, respectively, converge to produce a depression or valley 40 centrally located with respect to the group of four pyramids A, B, C and D.

On the opposite or bottom surface of the sheet, the depressions or valleys serve as prongs (see FIG. 3) which aid in holding the sheet stationary on the surface.

Figure 3:
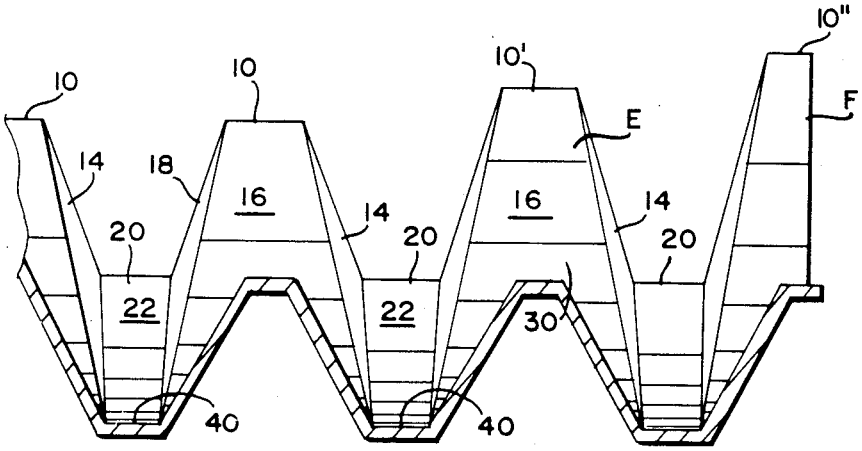
FIG. 3 is a sectional view taken along the line 3-3 of FIG. 1.

From FIG. 3, it may be seen that surfaces 20, 30 lie in a first horizontal plane substantially midway between an upper second horizontal plane defined by top surfaces 10, and a third lower horizontal plane defined by surfaces 40. The vertical distance between top surfaces 10 and bottom surfaces 40 is preferably about two inches, while the thickness of the sheet material per se may be on the order of 1/16 to ⅛ inch. It will be understood, of course, that these dimensions, and particularly the vertical height of the sheets may vary depending upon the particular use of the sheet.

It will be further understood that the above described configuration permits the sheets to be nested, one within another, for easy transport. In addition, the surface configuration allows adjacent sheets to be overlapped at respective edges to facilitate anchoring of a number of sheets over an area to be recovered.

The pattern described above is repeated over essentially the entire sheet with minor areas of exception as explained below.

As best seen in FIGS. 1 and 4, one widthwise edge 8 of the sheet lies adjacent a vertical row of truncated pyramids F, which, in turn, lie adjacent a parallel row of full pyramids E. As viewed in FIG. 3, it may be seen that pyramids E and F are formed with flat top surfaces 10', 10'', respectively, which are at progressively higher levels than top surfaces 10 of the remainder of the pyramids formed in the sheet. This configuration has the effect of "thickening" the sheet along one of its widthwise edges to add a degree of rigidity to the sheet and to facilitate alignment of a plurality of sheets over a large area.

The other significant structural discontinuity relates to a plurality of apertures which may be stamped or otherwise suitably formed in the sheet, for facilitating the installation of plants and/or seedlings. FIG. 5 illustrates a mulching sheet 2 in schematic form, provided with a plurality of apertures 42 arranged in a predetermined pattern. It will be understood that the number, size and overall pattern of apertures will depend on the desired plant density, the size of the individual plants, and the extent of the root system developed by the plants, and energetics of the given area. For example, for small plants, apertures approximately two inches in diameter, or two inches square, may be desirable, while for larger plants, apertures of four or more inches in diameter, or four or more inches square may be appropriate. In any event, the apertures permit sunlight to reach the plants while the surrounding three dimensional surfaces protect the plants from washout by dissipating wave energy and aggregating sand within, the depressions 40 and apertures 42.

The apertures may be centered about the depressions 40, e.g., such that the apertures are defined by edges cutting through top surfaces of adjacent pyramids. Such apertures can thus be in the shape of squares of various sizes, and can receive plants with or without associated cardboard containers of a similar size.

Additional letting apertures may be provided in the sheet to allow development and growth of new plants from rhizome development.

By pre-stamping or otherwise suitably forming the plant-receiving apertures in a mulching sheet, in accordance with predetermined plant density requirements, a readily observable indicator is provided for quick and accurate check on compliance with, for example, contract specifications requiring such density.

Turning now to FIG. 6, there is shown a biodegradable stake 44, a plurality of which may be employed to secure the mulching sheet to the ground. The stake, which may be three feet or more in length, is provided with a pointed and barbed shaft 46 and a head 48 to facilitate placement in the ground by, for example, a wooden mallet or the like. The head is contoured and sized to be received in the depressions or valleys 40 and is employed as a load distribution device. Barbs 50 may be provided on the stakes for enhancing attachment to the substrate. It will be appreciated that the combination of stakes provided with heads 48 fitting into depressions 40, and barbs 50 biting into the substrate will prevent any significant movement of the sheet in any direction.

The stake 44, like the mulching sheet 2, may be formed of a biodegradable material which contains plant nutrients, fertilizers, etc.

It will be appreciated that a number of such stakes may be employed to hold down a 4' by 8' sheet of mulching material. The stakes insure stationary placement of the sheets in engagement with the ground so that the majority of the backwash from a wave will flow over the top surface of the sheet. However, relatively small amounts of water receding under the sheet is tolerable and will not result in plant washout.

In utilizing the above described mulching material to recover and revegetate shorelines subjected to low to moderate wave energy, or other terrains subject to erosion processes, the following steps are called for:

(a) providing a plurality of relatively thin sheets of biodegradable material provided with a three-dimensional pattern as described herein, and a plurality of plant-receiving apertures;

(b) securing said plurality of sheets in overlapping relationship to the shoreline area to be recovered; and (c) installing plants and/or seedlings in the ground immediately beneath said apertures.

It is anticipated that the mulching material of this invention, provided with a hydrophobic coating as described hereinabove, will biodegrade over a period of three or four months, long enough to allow plants to send out rhizomes and to develop a sufficiently strong root system as to stand on their own without substantial danger of washout.

It will thus be seen that the mulching sheet in accordance with this invention permits recovery and revegetation of slopes, depressions, ditches, or natural drainage areas subject to erosion, as well as shorelines subjected to low to moderate wave energy and other erosion processes. Unlike most traditional "barriers" which lose effectiveness over time, the plant barrier established with the aid of the herein described mulching sheet becomes stronger over time, with little or no maintenance.

In a related aspect of the invention, it is contemplated that the mulching sheet of this invention will have similar utility and advantages as an erosion control device in an underwater environment. It may be desirable in such case to reduce the size of the sheets to, for example, two foot squares for ease of handling.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of recovering and revegetating shorelines subjected to waves of low to moderate energy comprising the steps of:

(a) providing a plurality of relatively thin, solid sheets of biodegradable material provided with coating means for delaying biodegradation, each sheet of which has an upper and lower surface, and a pattern of projections and depressions which extend above and below, respectively, intermediate flat surfaces of said sheet, said pattern being interrupted by a plurality of plant-receiving apertures formed therein in accordance with predetermined plant density requirements;

(b) securing said plurality of sheets in edge overlapping relationship to the shoreline area to be recovered; and (c) installing plants in the ground beneath said apertures so that said projections and depressions serve to dissipate wave energy and to collect sediment to thereby prevent washout of said plants.

2. A method as defined in claim 1 wherein step (a) is further practiced by suspending plant nutrients within said material.

3. A method as defined in claim 2 wherein said coating means comprises a paraffin composition.

4. A method as defined in claim 1 wherein step (b) is practiced by driving a plurality of biodegradable stakes through each of said sheets.

5. Mulching material for erosion control and for fostering plant growth comprising:

a relatively thin, solid sheet of biodegradable material having upper and lower surfaces lying in substantially horizontal first and second planes, respectively, and peripheral lengthwise and widthwise edges lying in a third plane substantially midway between said first and second planes; said sheet formed over substantially its entire surface with a pattern of multiple projections and depressions, a majority of said projections terminating in flat top surfaces lying in said first plane and all of said depressions terminating in flat surfaces lying in said second plane, said projections being connected by a plurality of flat surfaces lying in said third plane; said sheet being provided with a plurality of plant receiving apertures in predetermined locations within said pattern, and said sheet further comprising surface coating means for temporarily delaying the biodegradation of said sheet.

6. Mulching material as defined in claim 5 wherein said material comprises cardboard and said surface coating means comprises a hydrophobic composition.

7. Mulching material as defined in claim 1, wherein said projections each have a generally truncated pyramid shape formed by four, upwardly and inwardly extending, tapered surfaces which terminate at upper ends in a first flat top surface which forms a portion of said top surface of said sheet.

8. Mulching material as defined in claim 7 wherein said truncated pyramid-shaped projections are arranged in parallel rows.

9. Mulching material as defined in claim 7 wherein said truncated pyramid-shaped projections are arranged in a pattern of mutually perpendicular rows with respect to each other and with respect to the lengthwise and widthwise edges of said sheet.

10. Mulching material as defined in claim 8 wherein with the exception of pyramid-shaped projections adjacent said apertures, each of said four upwardly and inwardly extending, tapered side surfaces of each truncated-pyramid shaped projections is connected to a like side surface of an adjacent truncated, pyramid-shaped projection by a substantially flat surface lying in a third horizontal plane located substantially midway between said upper and lower planes.

11. Mulching material as defined in claim 10 wherein each of said substantially flat surfaces lying in said third horizontal plane is connected to surfaces which extend downwardly and terminate in said depressions, said depressions lying in said lower plane.

12. Mulching material as defined in claim 11 wherein said depressions are arranged in parallel rows.

13. Mulching material as defined in claim 11 wherein said material comprises cardboard, said surface coating means comprises a hydrophobic coating, and wherein said material is formed with plant nutrients therein.

14. Mulching material as defined in claim 11 wherein said material comprises cardboard, said surface coating means comprises a hydrophobic coating, and wherein said material is formed with plant nutrients therein.

15. Mulching material as defined in claim 10 wherein two rows of truncated pyramid-shaped projections extending along one widthwise edge of said sheet have second and third flat top surfaces which lie above said first flat top surfaces.

16. Mulching material as defined in claim 5 wherein said material is formed with plant nutrients therein.

17. A biodegradable sheet of mulching material for controlling erosion and protecting plant growth in shoreline areas subjected to waves of low to moderate energy comprising:

three dimensional, repetitive pattern means extending over substantially the entire sheet for dissipating the wave energy and for aggregating sand and sediment as waves flow over said sheet, said pattern means including a plurality of projections and depressions, said projections and depressions extending above and below, respectively, a substantially horizontal plane containing peripheral edges of the sheet;

aperture means for receiving plants, said aperture distributed throughout said sheet material in predetermined locations wherein said pattern means and said apertures combine to protect plants from washout; and first means along at least one of said peripheral edges of said sheet for facilitating attachment of said sheet to a substantially identical sheet; second means for securing said sheet to said shoreline area; and wherein said depressions serve as a third means for holding the sheet stationary on said shoreline areas.

18. The biodegradable sheet as defined in claim 17 wherein said material is further provided with means applied to upper and lower surfaces thereof for delaying biodegradation of said sheet material.

19. The biodegradable sheet as defined in claim 18 wherein said material is relatively thin cardboard.

20. The biodegradable sheet material as defined in claim 18 wherein delaying means comprises a hydrophobic coating.

21. The biodegradable sheet as defined in claim 17 wherein said projections and depressions are formed as a repeating pattern in a plurality of parallel rows.

22. The biodegradable sheet as defined in claim 17 wherein said means for receiving plants comprise apertures formed in said sheet material.

23. The biodegradable sheet as defined in claim 17 wherein said second means for securing said sheet material comprises biodegradable stakes.

24. The biodegradable sheet as defined in claim 17 wherein said sheet is about four feet in width and about eight feet in length.

25. Mulching material for erosion control and for fostering plant growth comprising:

a relatively thin sheet of biodegradable material having top and bottom surfaces lying in substantially horizontal upper and lower planes, respectively, said sheet formed with a pattern of multiple projections and depressions, each of said projections having a generally truncated pyramid shape formed by four, upwardly and inwardly extending, tapered surfaces which terminate at upper ends in a first flat top surface which forms a portion of said top surface of said sheet, said truncated pyramid shaped projections arranged in parallel rows, wherein a plurality of plant receiving apertures are provided in said sheet in predetermined locations, wherein with the exception of pyramid-shaped projections adjacent said apertures, each of said four upwardly and inwardly extending, tapered side surfaces of each truncated-pyramid shaped projection is connected to a like side surface of an adjacent truncated, pyramid-shaped projection by a substantially flat surface lying in a third horizontal plane located substantially midway between upper and lower planes said sheet further comprising surface coating means for temporarily delaying the biodegradation of said sheet.

26. Mulching material as defined in claim 25 wherein said side surfaces of said second set of projections converge at lower ends thereof to form a plurality of depressions defined by flat bottom surfaces.

27. Mulching material as defined in claim 26 wherein said depressions are arranged in parallel rows.

28. Mulching material as defined in claim 25 wherein two rows of truncated pyramid-shaped projections extending along one widthwise edge of said sheet have second and third flat top surfaces which lie above said first flat top surfaces.

* * * * *